US005607258A

United States Patent [19]

Eungard

[11] Patent Number: 5,607,258

[45] Date of Patent: Mar. 4, 1997

[54] SCUBA DIVING HARNESS FOR USE WITH A BUOYANCY CONTROL DEVICE

[75] Inventor: William C. Eungard, Waterford, Wis.

[73] Assignee: Johnson Worldwide Associates, Sturtevant, Wis.

[21] Appl. No.: 520,727

[22] Filed: Aug. 29, 1995

[51] Int. Cl.[6] ..... B63C 11/02

[52] U.S. Cl. ..... 405/186; 224/650; 441/106

[58] Field of Search ..... 405/186; 224/148.5, 224/148.6, 638, 644, 209, 215, 211; 441/106, 111, 112, 114, 108

[56] References Cited

U.S. PATENT DOCUMENTS

| | | | |
|---|---|---|---|
| D. 299,286 | 1/1989 | Faulconer et al. . | |
| D. 300,340 | 3/1989 | Faulconer . | |
| 3,877,098 | 4/1975 | Braly . | |
| 4,000,534 | 1/1977 | Cerniway et al. . | |
| 4,016,616 | 4/1977 | Walters . | |
| 4,324,234 | 4/1982 | Maness . | |
| 4,449,655 | 5/1984 | Germe . | |
| 4,523,914 | 6/1985 | Faulconer et al. . | |
| 4,561,853 | 12/1985 | Faulconer et al. . | |
| 4,608,940 | 9/1986 | Bulin . | |
| 4,623,316 | 11/1986 | Ratliff . | |
| 4,676,418 | 6/1987 | Lowe | 224/638 |
| 4,690,314 | 9/1987 | Faulconer et al. . | |
| 4,752,263 | 6/1988 | Pritchard et al. . | |
| 4,778,307 | 10/1988 | Faulconer . | |
| 4,779,554 | 10/1988 | Courtney . | |
| 4,810,134 | 3/1989 | Faulconer et al. . | |
| 4,887,932 | 12/1989 | Toth . | |
| 4,913,589 | 4/1990 | Faulconer et al. . | |
| 4,918,790 | 4/1990 | Cirket et al. . | |
| 4,952,095 | 8/1990 | Walters . | |
| 4,990,115 | 2/1991 | Vorhauer et al. . | |
| 5,011,334 | 4/1991 | Vorhauer . | |
| 5,020,941 | 6/1991 | Bulin et al. . | |
| 5,046,894 | 9/1991 | Bergstrom . | |
| 5,074,714 | 12/1991 | Franco . | |
| 5,249,890 | 10/1993 | Bergstrom . | |
| 5,256,094 | 10/1993 | Canna . | |
| 5,295,765 | 3/1994 | Chol . | |
| 5,346,419 | 9/1994 | Kaiser . | |
| 5,361,955 | 11/1994 | Gregory | 224/644 X |
| 5,363,790 | 11/1994 | Matsuoka . | |
| 5,378,084 | 1/1995 | Walters et al. . | |
| 5,385,496 | 1/1995 | Seligman . | |
| 5,441,367 | 8/1995 | Toth . | |
| 5,451,121 | 9/1995 | Seligman | 405/186 |

*Primary Examiner*—Dennis L. Taylor
*Attorney, Agent, or Firm*—Foley & Lardner

[57] ABSTRACT

A harness for use in scuba diving is disclosed. The harness is independent of the air cell and includes arcuate shoulder straps to promote the comfort of the scuba diver, particularly when moving about above water with the air tanks and other scuba equipment in place. The harness also has an affixed webbing system to which a rigid back pack may be adjustably mounted.

23 Claims, 5 Drawing Sheets

FIG. 6
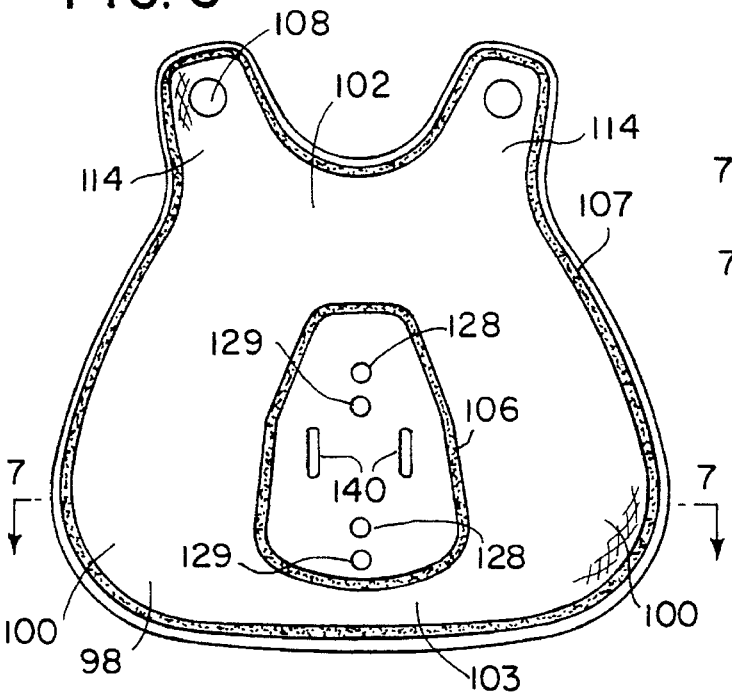
FIG. 5
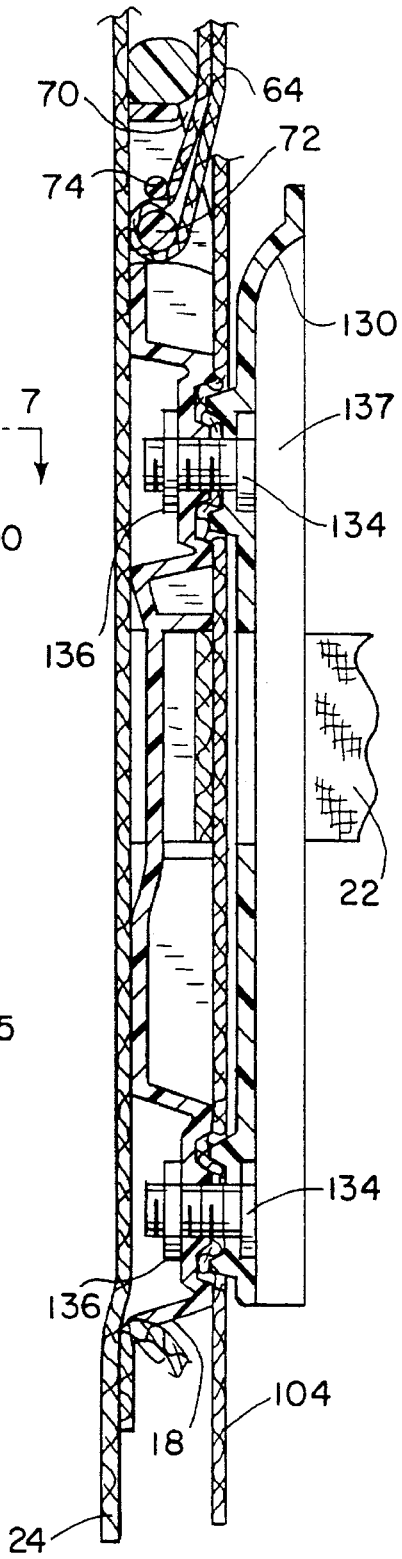
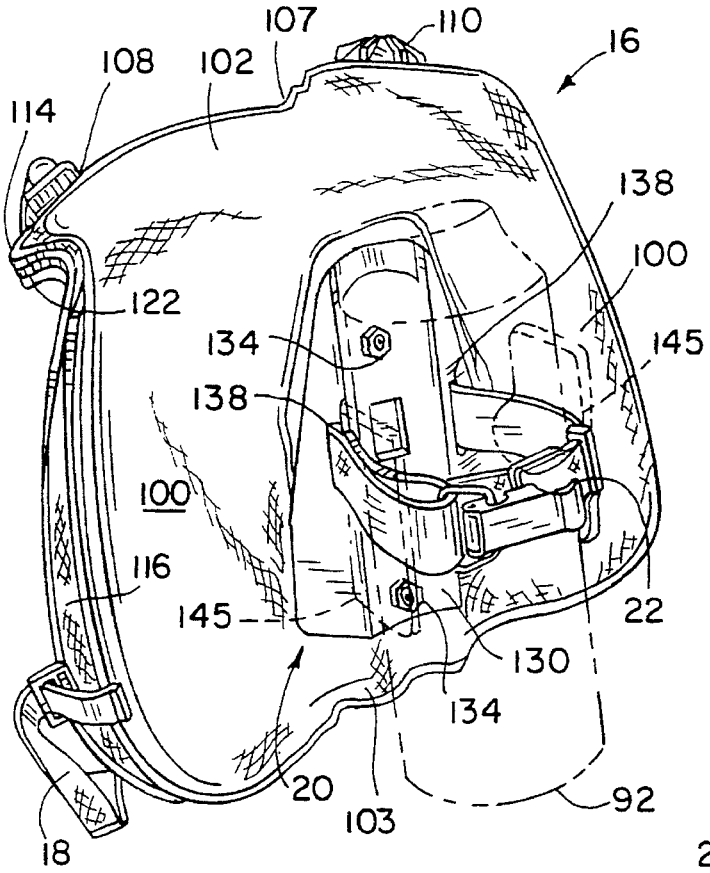
FIG. 8

FIG. 10
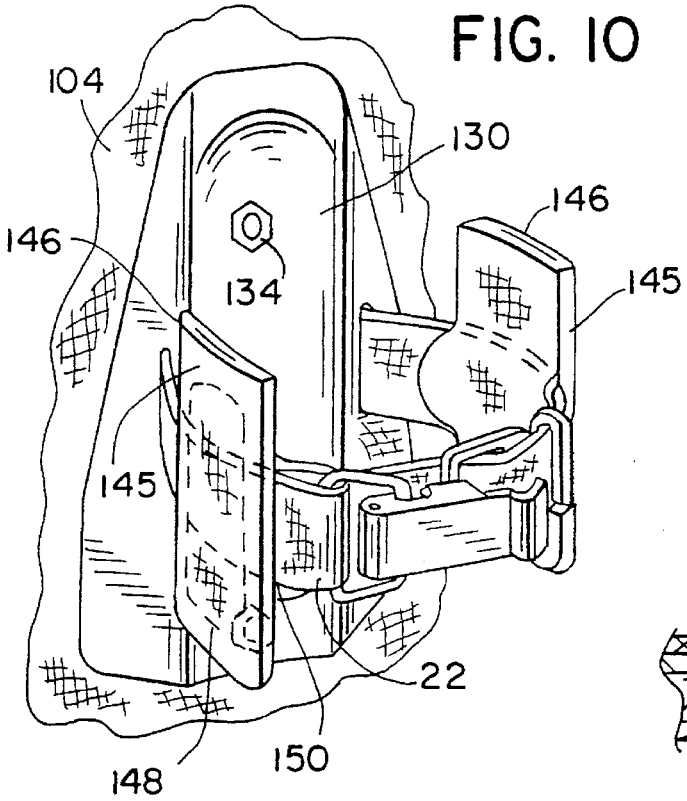
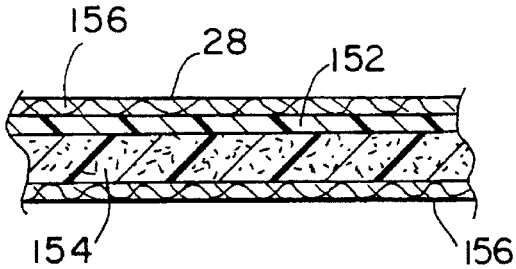
FIG. 11
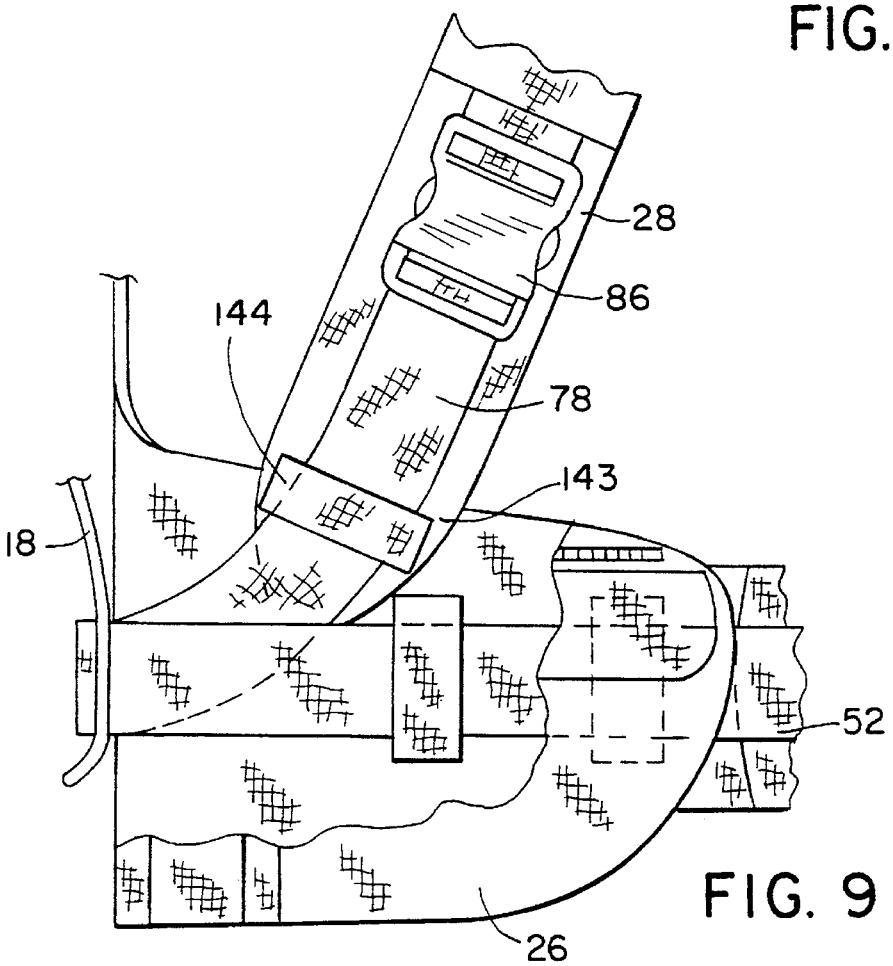
FIG. 9

SCUBA DIVING HARNESS FOR USE WITH A BUOYANCY CONTROL DEVICE

FIELD OF THE INVENTION

The present invention relates generally to scuba diving equipment, and particularly to a harness assembly worn by the scuba diver and to which various scuba equipment is attached.

BACKGROUND OF THE INVENTION

Scuba diving involves prolonged underwater experiences that require both a supply of air, often in the form of air that is compressed and held in pressurized tanks, and control over the buoyancy of the diver to maintain the scuba diver at desired depths beneath the surface. Buoyancy control is typically achieved by attaching a sufficient number of weights to the diver to cause the diver to sink beneath the surface (negative buoyancy) and then to provide an inflatable air cell or a bladder that permits the diver to counteract the effect of the weights. The air cell permits the diver to remain at a stationary depth (neutral buoyancy) or to rise towards the surface (positive buoyancy) by inflating the air cell. Usually, the air cell is connected to the compressed air tank via a valve and hose so the diver may selectively inflate the air cell with air from his or her compressed air tank.

Conventional buoyancy control devices incorporate a combination air cell and vest-type harness that may be worn around the diver's torso. The compressed air tank is then attached to this assembly by, for instance, straps which hold the tank along the back of the scuba diver. Typically, the air cell extends along the sides and chest of the scuba diver and may be selectively inflated or deflated by simply actuating the control valve that links the air cell to the pressurized tank. The weights that cause the scuba diver to sink are typically lead weights attached about the waist of the scuba diver on a weight belt or contained within pockets mounted at the sides of the buoyancy control device.

One problem with some existing buoyancy control devices is that the air cell and harness are an integral unit and often must be replaced in the event of damage. Another problem is the location of the air cell at the sides and front of the diver where it can be bulky and interfere with activities of the diver. It would be advantageous to design a harness that existed independently of the air cell which could be mounted at the back of the diver with the pressurized tank.

Some existing buoyancy control devices incorporate detachable air cells mounted to the back of a harness, but many of those air cells continue to have portions that wrap around the sides of the diver. Additionally, many of those devices can cause the diver difficulty in maintaining proper orientation of his or her body at the water's surface.

Another problem with existing buoyancy control devices is the discomfort caused the scuba diver when maneuvering in the boat or above the surface of the water. The weights, compressed air tanks and various other diving equipment are supported by the harness which typically has a pair of straight shoulder straps and a belt to hold the equipment in place. Thus, a substantial amount of weight is placed directly on top of the scuba diver's shoulders. It would be advantageous to have an independent harness with shoulder straps designed to comfortably and evenly support the weight of the scuba diving equipment.

SUMMARY OF THE INVENTION

The present invention features a scuba diving harness designed to support various scuba equipment used by a diver. The scuba diving harness includes a back panel configured for placement along the back of the diver. Additionally, a waist strap assembly is connected at least partially to the back panel and is configured to extend generally about the waist of the diver. The waist strap assembly includes an adjustable fastener and may, for instance, include a combination cummerbund with an adjustable fastener and a belt having its own adjustable fastener.

A pair of shoulder straps extended generally between the back panel and the waist strap assembly. Each shoulder strap is designed to extend over the shoulder and chest area of the diver. The particular design of the shoulder strap more evenly distributes the weight of the scuba diving equipment. Each shoulder strap has an arcuate central edge and an arcuate outside edge. The curvature of the arcuate outside edge is greater than the curvature of the arcuate central edge to cause the shoulder straps to extend towards one another in a more central region of the diver's chest. Thus, the weight of the scuba diver's compressed air tank and other equipment is better distributed across the diver's shoulders and chest.

Additionally, the scuba diving harness may include a webbing system attached thereto and designed to adjustably hold a rigid back pack to the back panel of the harness. The back pack is used to facilitate mounting of an air cell and compressed air tank.

BRIEF DESCRIPTION OF THE DRAWINGS

The invention will hereafter be described with reference to the accompanying drawings, wherein like reference numerals denote like elements, and:

FIG. 5 is a cross-sectional view taken generally along line 5—5 of FIG. 3 when the buoyancy control device is in its assembled condition;

FIG. 6 is a back view of an air cell according to one preferred aspect of the present invention;

FIG. 8 is a perspective view of the back of the air cell according to one aspect of the present invention and showing a compressed air tank in phantom lines;

FIG. 9 is a partial view of a lower portion of the webbing connected to the back pack;

FIG. 10 is a perspective view of weight pockets cooperating with the tank belt; and FIG. 11 is a cross-sectional view taken generally along lines 11—11 of FIG. 1.

DETAILED DESCRIPTION OF THE PREFERRED EMBODIMENT

Figure 1:
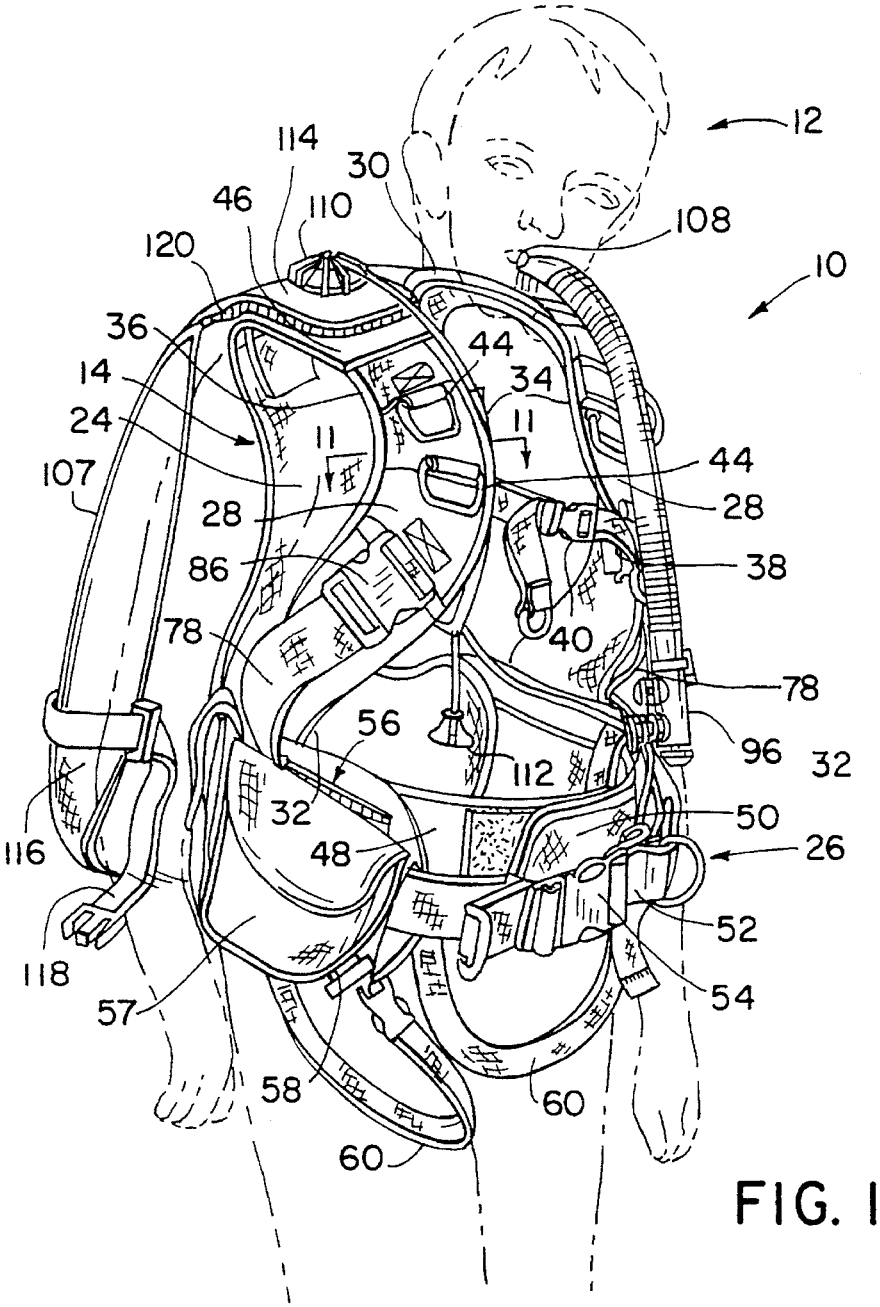
FIG. 1 is a perspective view of a buoyancy control device according to a preferred form of the present invention and worn by a scuba diver.
Figure 7:
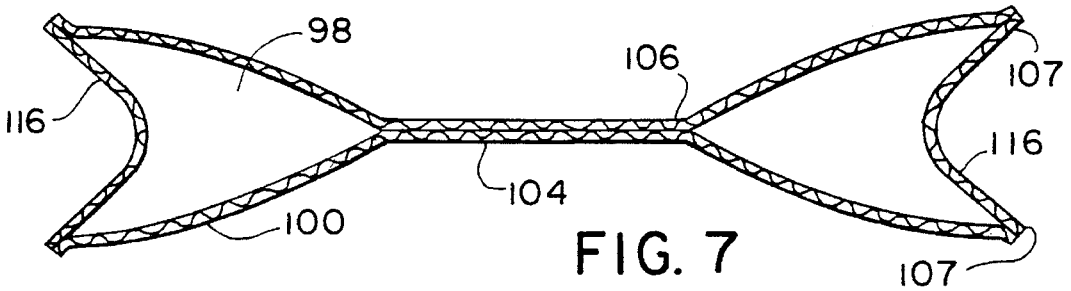
FIG. 7 is a cross-sectional view taken generally along line 7—7 of FIG. 6.
Figure 2:
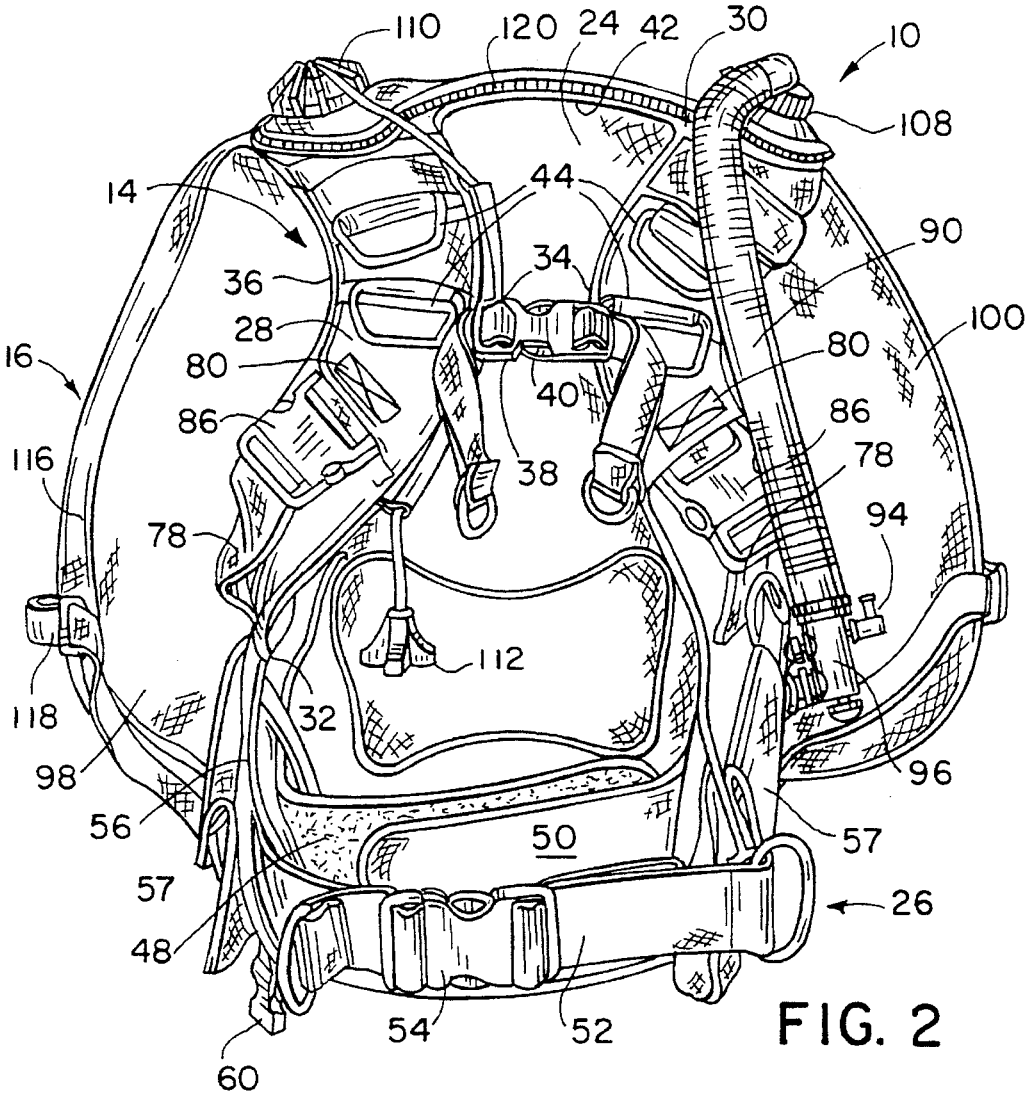
FIG. 2 is a front view of the buoyancy control device of FIG. 1.
Figure 3:
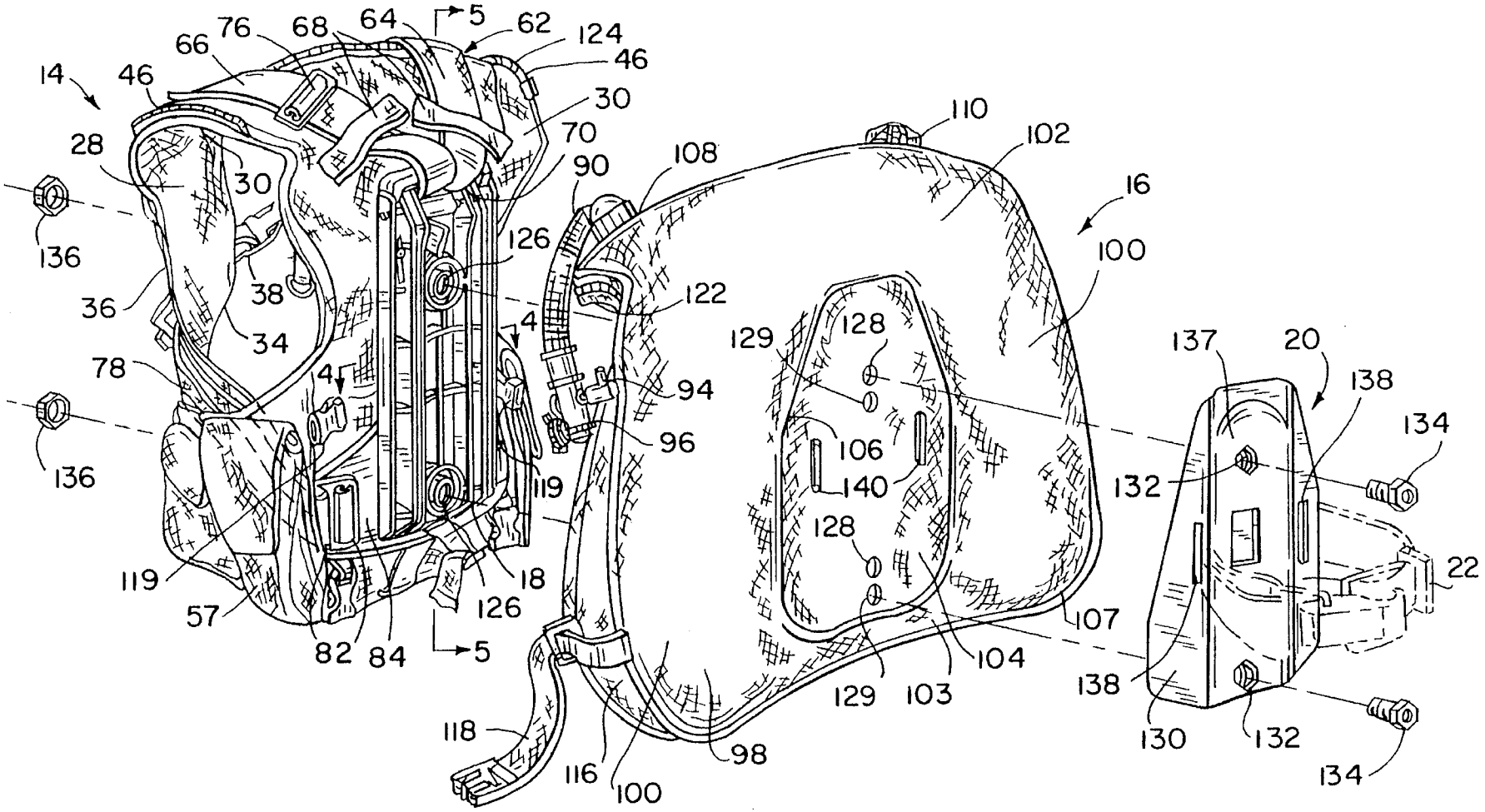
FIG. 3 is an exploded view of the buoyancy control device of FIG. 1 showing the harness, air cell and back plate positioned for assembly.

Referring generally to FIGS. 1–3, a buoyancy control device used for scuba diving is illustrated as worn by a scuba diver 12. Buoyancy control device 10 generally includes a harness 14, an air cell system 16, a back pack 18 (see FIG. 3), a back mounting plate 20 and a tank belt 22 (see FIG. 3).

Harness assembly 14 generally includes a back panel 24 designed to lie along the back of scuba diver 12 as illustrated in FIG. 1. A waist strap assembly 26 is connected to back panel 24 and is positioned to extend generally about the waist of diver 12. A pair of shoulder straps 28 are each connected to back panel 24 at an upper attachment region 30. Each shoulder strap 28 also extends downwardly towards either waist strap assembly 26 or the lower portion of back panel 24 or a combination of the two at a lower attachment region 32.

Each shoulder strap is designed to extend generally over the shoulder and across the central chest area of diver 12 as illustrated in FIGS. 1 and 2. In other words, shoulder straps 28 extend inwardly towards the sternum or central area of the chest of diver 12 to more uniformly support the weight of various scuba diving equipment that may be attached to harness assembly 14. Although shoulder straps 28 may have a variety of shapes and forms, the preferred form is generally arcuate and each strap has an arcuate central edge 34 and an arcuate outside edge 36. Thus, the curvature of outside edges 36 is greater than the curvature of central edges 34.

Shoulder straps 28 may further be held in place along the torso of diver 12 by a crossover strap 38, preferably connected between the apexes of arcuate central edges 34. Crossover strap 38 may also include a fastener 40, such as a snap or buckle as are known in the art.

Back panel 24 and shoulder straps 28 cooperate to provide a neck opening 42. The unique design of shoulder straps 28 allows shoulder straps 28 and particularly arcuate central edges 34 to be closer to one another than the diameter of neck opening 42 when harness assembly 14 is worn by diver 12.

Shoulder straps 28 often also include a plurality of loops or rings 44 to which various accessories (not shown) may be attached. Additionally, shoulder straps 28 may include air cell attachment regions 46, preferably disposed proximate upper attachment regions 30, and configured to receive air cell 16 as will be more fully described below.

Waist strap assembly 26 may have a variety of configurations, but as illustrated, it preferably includes a cummerbund 48 having a fastener 50, such as a hook and loop type fastener, commonly known as Velcro™. Often, waist strap assembly 26 will also include a belt 52 disposed outside cummerbund 48 and also having a fastener 54.

Optionally, weight pockets 56 may be attached to waist strap assembly 26. Weight pockets 56 are generally designed to receive conventional lead weights used by divers and may include a quick release mechanism 58 having a tear-away bottom to quickly release the weights should diver 12 need to surface immediately. Optional accessory pockets 57 are sometimes mounted adjacent weight pockets 56. Also, crotch straps 60 may be attached to waist strap assembly 26 or a combination of waist strap assembly 26 and back panel 24 to further secure harness assembly 14 around the torso of diver 12.

Harness assembly 14 further includes a webbing system 62 as best shown in FIG. 3. Webbing system 62 is affixed to one or more of the back panel 24, waist strap assembly 26 and/or shoulder straps 28. As illustrated, webbing system 62 preferably includes an upper web strap 64 attached to shoulder strap 28 by an appropriate fastener, such as stitching 66 or an appropriate adhesive. Upper web strap 64 is also held in place by a pair of flexible retainers 68 affixed generally to back panel 24 by appropriate stitching or adhesive. Upper web strap 64 is threaded through an upper opening 70 of back pack 18, around a cooperating main pin 72 and past retainer pin 74 as best illustrated in FIG. 5. Upper web strap 64 is actually comprised of two components connected through a buckle 76, as is well known to those of ordinary skill in the art, to permit the lengthening or shortening of upper web strap 64 to thereby adjust the position of back pack 18 along back panel 24.

Webbing system 62 also includes a pair of lower web straps 78 which are preferably fastened to shoulder straps 28 by an appropriate fastener, such as stitching 80 or other appropriate fasteners, such as adhesive. Each lower web strap 78 extends along its corresponding shoulder strap 28 and wraps around to the rear of back panel 24 as illustrated in FIGS. 2 and 3. Each lower strap engages the lower portion of backpack 18, preferably through pairs of openings 82 formed in each of a pair of flanges 84 that extend outwardly from the lower portion of back pack 18 as best illustrated in FIG. 3. Preferably, each lower strap also extends from back pack 18 to form a portion of waist strap assembly 26 and belt 52 as best illustrated in FIG. 9. As described above with respect to upper strap 64, each lower web strap 78 usually includes two components connected through a quick release buckle 86 that permits the lengthening or shortening of each lower web strap 78 to further facilitate adjustment of back pack 18 along back panel 24.

Air cell system 16, as seen from a variety of viewpoints in FIGS. 3–8, is selectively inflatable through an air hose 90 which may be connected to a pressurized tank of air 92 (shown in phantom in FIG. 8) via a supply line (not shown) that connects to a valve inlet 94 of valve 96. Scuba diver 12 can selectively control the inflation and deflation of air cell system 16 via valve 96 as is well known. Thus, diver 12 can control his descent, ascent, or neutral buoyancy while under water.

As illustrated, air cell system 16 includes an air cell 98 that is selectively inflatable. Air cell 98 preferably has a pair of inflatable legs 100 in fluid communication with and connected by an upper inflatable crossover portion 102 and a lower inflatable crossover portion 103.

A mounting panel 104 extends between inflatable legs 100 and is designed to permit air cell 98 to be securely attached to back pack 18. Mounting panel 104 is not inflatable and is sealed from air cell 98 by a perimeter seal 106 (e.g. a heat seal or adhesive seal) that extends about the perimeter of mounting panel 104. A perimeter seal 107 preferably extends about the exterior perimeter of air cell 98. Thus, a variety of holes can be formed through mounting panel 104 or a variety of mounting fixtures can be attached to mounting panel 104 without risk of rupturing air cell 98. Mounting panel 104 could be used with air cells having a variety of configurations, including U-shaped air cells, H-shaped air cells and T-shaped air cells.

Air is received into the interior of air cell 98 through an inlet 108 and may be exhausted either back through inlet 108 via air hose 90 and valve 96 or through a dump valve 110 that is opened either by excess pressure in air cell 98 or by manually pulling a handle 112 (see FIG. 2).

Preferably, inlet 108 and dump valve 110 are located in a pair of anti-torque cells 114. Anti-torque cells 114 are in fluid communication with inflatable cross over portion 102 but are disposed for location over the shoulders of diver 12 when air cell system 16 is attached to harness assembly 14.

Anti-torque cells 114 permit air to accumulate proximate the divers head and shoulders which makes it easier for the diver to maintain a comfortable orientation, particularly when swimming at the water's surface. The anti-torque cells 114 tend to reduce the buoyancy torque effects of inflating legs 100. This permits the diver to maintain a more comfortable orientation in the water.

Optionally, air cell 98 may include expandable side panels 116. Each expandable side panel includes a folded sheet that expands as air cell 98 is inflated. This permits a more compact air cell system 16 when in the uninflated state. Expandable side panels 116 may also be located at other positions along air cell 98, for instance, along the top of inflatable crossover portion 102. Additionally, expandable side panels 116 may be tied together or more securely tied to harness assembly 14 by respective tie straps 118. Tie straps 118 are designed to extend between back pack 18 and back panel 24 so they may be connected at quick release buckles 119, as best shown in FIG. 3.

Air cell system 16 can be attached to harness assembly 14 in a variety of ways, but one secure way is by using a zipper 120 in which one portion 122 of zipper 120 is affixed to air cell system 16 and the other portion 124 of zipper 120 is affixed to harness assembly 14. Zipper 120 can be used at a variety of locations along the perimeter or interior of air cell system 16 or along its entire perimeter. In the illustrated embodiment, zipper portion 122 is disposed along the perimeter of anti-torque cells 114 and the portion of neck opening 42 therebetween. Accordingly, the corresponding zipper portion 124 is affixed to harness assembly 14 at a location which cooperates with zipper portion 122 to maintain anti-torque cells 114 generally above the shoulders of diver 12.

In the illustrated embodiment, air cell system 16 is also securely affixed to a rigid back pack 18 via mounting panel 104. In this embodiment, back pack 18 includes at least one and preferably a pair of openings 126 that correspond to at least one and preferably a pair of openings 128 disposed through mounting panel 104. An appropriate fastener may be inserted through the corresponding openings of back pack 18 and mounting panel 104 to secure air cell 98 with respect to back pack 18.

Figure 4:
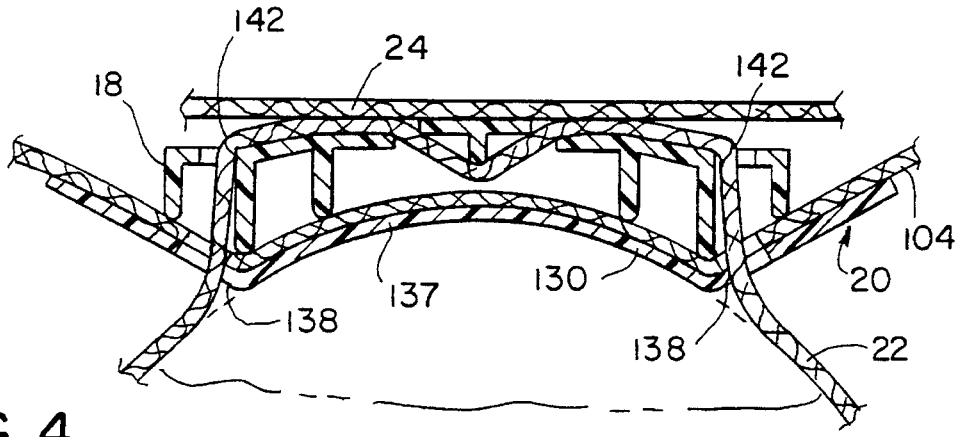
FIG. 4 is a cross-sectional view taken generally along line 4—4 of FIG. 3 when the buoyancy control device is in its assembled condition.

However, in the preferred embodiment, mounting panel 104 is sandwiched between back pack 18 and a rigid plate 130 that also includes at least one and preferably two openings 132 properly located for alignment with openings 128 and openings 126 when mounting panel 104 is sandwiched between back pack 18 and rigid plate 130. Thus, a fastener, and preferably a pair of fasteners (e.g. bolts) 134 may be inserted through openings 132, 128, and 126 respectively, and held in place by corresponding nuts 136, as best illustrated in FIGS. 3, 4 and 5. A variety of other fasteners and clamping mechanisms could also be used to hold rigid plate 130 to back pack 18 while sandwiching mounting panel 104 therebetween. Openings 132 are recessed to receive the heads of bolts 134 within a concave portion 137 of rigid plate 130. Concave portion 137 is designed to receive pressurized air tank 92. A second set of openings 129 can also be formed through panel 104 to permit adjustability of air cell 98 with respect to back pack 18.

Rigid plate 130 may also have a pair of slots 138 through which tank belt 22 extends. In this configuration, a matching pair of slots 140 are formed through mounting panel 104 of air cell system 16. An additional pair of slots 142 are then also formed through back pack 18. Thus, tank belt 22 extends through rigid plate 130, mounting panel 104 and back pack 18 as best illustrated in FIGS. 3 and 4.

Although a variety of webbing systems 62 could be incorporated with harness assembly 14, one preferred embodiment is set forth in detail in FIG. 9. In this embodiment, each lower web strap extends downwardly along its corresponding shoulder strap 28 and wraps through one of the pairs of openings 82 in back pack 18 before becoming part of weight strap assembly 26 and forming belt 52 as illustrated in FIG. 9. Thus, each lower web strap 78 comprises a portion of belt 52. Also, each lower web strap 78 is separable at the quick release buckle 86. In this embodiment, each shoulder strap 28 includes an unattached end 143 that is held proximate waist strap assembly 26 by the adjacent lower web strap 78.

Preferably, a retainer 144 is affixed to end 143 by appropriate stitching or adhesive. Retainer 144 is typically a somewhat flexible or elastic strap which permits the insertion of at least a portion of quick release buckle 86 therethrough. However, once buckle 86 is inserted through retainer 144 as illustrated in FIG. 9, retainer 144 maintains an appropriately tight fit about lower web strap 78 to prevent the inadvertent movement of the lower half of quick release buckle 86 therethrough.

This feature permits easy removal of harness assembly 14 from the torso of diver 12 by simply actuating quick release buckle 86 and permitting it to split apart, thereby effectively loosening shoulder straps 28. However, retainers 144 will prevent the complete separation of shoulder straps 28 from waist strap assembly 26 by retaining the lower portion of quick release buckle 86. This permits easy reassembly when harness 14 is once again placed about the diver's torso.

Retainers 144 are particularly advantageous when diver 12 has weights in weight pockets 56. The retainer 144 prevents waist strap assembly 26 and the heavy weight pockets 56 from swinging freely downward against the legs of the diver.

As illustrated in FIG. 10, a pair of tank strap weight pockets 145 may be mounted to tank strap 22. Pockets 145 each have an upper opening 146 designed to receive a diver's weight 148 as shown in phantom in FIG. 10. Openings 146 may be sealed by an appropriate fastener, such as a hook and loop fastener commonly known as Velcro™. Weight pockets 145 also have flexible passages 150 therethrough which are sized to receive tank strap 22 as illustrated. Pockets 145 and weights 148 cooperate with anti-torque cells 114 to further assist diver 12 in maintaining a comfortable orientation at the water's surface.

In FIG. 11, a preferred embodiment of the cross sectional configuration of shoulder straps 28 is illustrated. A variety of materials and layers could be used, but it is preferred that each shoulder strap 28 includes a stiffener 152 designed to hold the strap in its desired shape, arcuate or otherwise. Stiffener 152 comprises, for example, a plastic sheet made of materials, such as mylar or polyethylene. Additionally, each shoulder strap 28 can include a layer of foam 154. Stiffener 152 and foam layer 154 are usually contained within an outer shell 156 made of various cloth materials known in the industry, such as 840 denier nylon pack cloth on one side of stiffener 152 and 420 denier nylon pack cloth on the other side.

It will be understood that the foregoing description is of a preferred exemplary embodiment of this invention and that the invention is not limited to the specific form shown. For example, the shape of the harness assembly and air cell system can be modified. A variety of materials, including hard plastics, nylons and cloth, as are commonly used and known to those of ordinary skill in the art, can be used and potentially interchanged in a variety of the components. The location of various belts, straps, buckles and other fasteners can be changed to accommodate the particular design. These and other modifications may be made in the design and arrangement of the elements without departing from the scope of the invention as expressed in the appended claims.

What is claimed is:

1. A scuba diving harness designed to support various scuba equipment used by a diver, comprising:

a harness assembly including a back panel configured for placement along the back of the diver;

a waist strap assembly connected to the back panel and configured to extend generally about to waist of the diver, the waist strap including an adjustable fastener;

a back pack for supporting a scuba tank;

a pair of shoulder straps extending generally between the back pack at a lower region thereof and the harness assembly, each shoulder strap being designed to extend over the shoulder and chest area of the diver; and a chest strap configured for coupling between the shoulder straps.

2. The scuba diving harness as recited in claim 1, wherein an upper region of each shoulder strap is coupled to an upper webbing strap, the upper webbing strap being coupled to the back pack.

3. The scuba diving harness as recited in claim 2, wherein the upper webbing strap is adjustable to permit positioning of the back pack.

4. The scuba diving harness as recited in claim 1, wherein a lower end of each shoulder strap is slidably coupled to the waist belt.

5. The scuba diving harness as recited in claim 1, further comprising a stiffener within each shoulder strap for maintaining the shape of the respective shoulder strap.

6. The scuba diving harness as recited in claim 5, wherein each stiffener includes a sheet of plastic.

7. The scuba diving harness as recited in claim 1, wherein the waist strap assembly includes a cummerbund having a cummerbund fastener and a belt having a belt fastener.

8. The scuba diving harness as recited in claim 1, further comprising an air cell attachment region.

9. The scuba diving harness as recited in claim 8, wherein the air cell attachment region includes a portion of a zipper attached to the pair of shoulder straps.

10. The scuba diving harness as recited in claim 1, wherein the back panel and the pair of shoulder straps cooperate to form a neck opening having a diameter greater than a distance between central edges of the pair of shoulder straps.

11. A scuba diving harness assembly to be worn by a diver, the scuba diving harness being configured to comfortably fit about the torso of the diver while supporting the weight of various scuba equipment, comprising:

a back panel;

a waist strap assembly connected to the back panel;

a back pack;

a left and a right shoulder strap, each shoulder strap being connected by an upper end to the back panel and by a lower end to the waist strap assembly, the left and the right shoulder straps extending towards one another from their respective upper and lower ends when the scuba diving harness assembly is worn by the diver; and a webbing system fixedly attached to at least one of the back panels, the waist strap assembly and the left and right shoulder straps, the webbing system cooperating with the back pack to hold the back pack adjacent to the back panel and to permit adjustment of the position of the back pack.

12. The scuba diving harness assembly as recited in claim 11, wherein the left shoulder strap and the right shoulder strap are arcuate in shape.

13. The scuba diving harness assembly as recited in claim 12, wherein the left shoulder strap and the right shoulder strap each have an arcuate central edge and an arcuate outside edge, the shoulder straps arcing towards the center of the diver's torso when the scuba diving harness assembly is worn by the diver.

14. The scuba diving harness assembly as recited in claim 11, wherein the back pack is rigid plastic having slots through which a portion of the webbing system extends.

15. The scuba diving harness assembly as recited in claim 14, wherein the webbing system includes a plurality of web straps affixed to at least one of the back panels, the waist strap and the left and right shoulder straps, the web straps being adjustably attached to the back pack.

16. The scuba diving harness assembly as recited in claim 11, wherein the left shoulder strap and the right shoulder strap each include an air cell attachment region including a portion of a zipper.

17. A scuba diving harness assembly designed to fit about the chest and back of a diver, the scuba diving harness assembly being configured to comfortably support various scuba diving equipment on the diver, comprising:

a back panel;

a back pack;

a first shoulder strap attached to the back panel at a first upper attachment region and to the back pack at a first lower attachment region; and a second shoulder strap attached to the back panel at a second upper attachment region and to the back pack at a second lower attachment region, wherein when the scuba diving harness assembly is worn by the diver, the first and second shoulder straps extend inwardly from their respective upper and lower attachment points generally towards the sternum of the diver's chest.

18. The scuba diving harness assembly as recited in claim 17, wherein the first shoulder strap and the second shoulder strap each have an outer side edge and a central side edge, the central side edge being longer than the outer side edge.

19. The scuba diving harness assembly as recited in claim 18, wherein the first shoulder strap and the second shoulder strap are each arcuate.

20. The scuba diving harness assembly as recited in claim 17, further comprising a webbing system affixed at least in part to the first and second shoulder straps, the webbing system also being adjustably connected to the back pack.

21. A scuba diving harness assembly designed to fit about the chest and back of a diver, the scuba diving harness assembly being configured to comfortably support various scuba diving equipment on the diver, comprising:

a harness including a back panel and a waist strap assembly;

a pair of shoulder straps connected to the back panel; and a lower web system connecting each shoulder strap to a lower region of the harness by a corresponding web strap, wherein each shoulder strap includes a quick release device for selectively coupling the web strap in a worn position and for selectively relaxing the web strap to a removal position without completely releasing the shoulder strap from the harness.

22. The scuba diving harness assembly as recited in claim 21, wherein each corresponding web strap is slidably engaged through a retainer and wherein the quick release device of each respective shoulder strap includes a buckle sized to prevent inadvertent movement past the retainer.

23. The scuba diving harness assembly as recited in claim 21, wherein each shoulder strap includes an outer cloth layer, a stiffener layer and a foam layer.

* * * * *